US005314511A

United States Patent [19]

Liotta, Jr. et al.

[11] Patent Number: 5,314,511

[45] Date of Patent: May 24, 1994

[54] DIESEL FUEL

[75] Inventors: Frank J. Liotta, Jr., Collegeville; Haven S. Kesling, Jr., Drexel Hill, both of Pa.

[73] Assignee: Arco Chemical Technology, L.P., Wilmington, Del.

[21] Appl. No.: 995,496

[22] Filed: Dec. 23, 1992

[51] Int. Cl.[5] ..... C10L 1/18

[52] U.S. Cl. ..... 44/322; 44/447; 44/448

[58] Field of Search ..... 44/322, 447, 448

[56] References Cited

U.S. PATENT DOCUMENTS

| | | | |
|---|---|---|---|
| 2,331,386 | 10/1943 | Gaylor | 44/387 |
| 2,378,341 | 6/1945 | Vaughan et al. | 44/322 |
| 2,655,440 | 10/1953 | Barusch et al. | 44/322 |
| 2,763,537 | 9/1956 | Barusch et al. | 44/326 |
| 2,891,851 | 6/1959 | Bailey et al. | 44/322 |
| 3,108,864 | 10/1963 | Barusch | 44/322 |
| 3,577,228 | 5/1971 | Rai et al. | 44/375 |
| 3,594,138 | 7/1971 | Badin | 44/385 |
| 3,594,140 | 7/1971 | Badin | 44/370 |
| 3,615,292 | 10/1971 | Badin | 44/363 |
| 4,753,661 | 6/1988 | Nelson et al. | 44/309 |
| 4,800,847 | 1/1989 | Pritchard | 44/322 |
| 4,857,073 | 8/1989 | Vataru et al. | 44/322 |
| 4,891,049 | 1/1990 | Dillon et al. | 44/387 |
| 4,892,561 | 1/1990 | Levine | 44/322 |
| 4,904,279 | 2/1990 | Kanne et al. | 44/387 |
| 5,004,480 | 4/1991 | Kanne | 44/387 |

FOREIGN PATENT DOCUMENTS

| | | |
|---|---|---|
| 80100827.7 | 9/1980 | European Pat. Off. . |
| 82109266.5 | 4/1983 | European Pat. Off. . |
| 59-232176 | 12/1984 | Japan . |
| 1246853 | 9/1971 | United Kingdom . |

OTHER PUBLICATIONS

Article entitled "Diesel Fuel Modification for Reduced Exhaust Emissions," by Richard E. Winsor and Danney E. Larkin. (Reference: *Impact of U.S. Environmental Regulations on Fuel Quality, ASTM STP 1160,* Kurt H. Strauss and Willaim Dukek, eds., American Society for Testing and Materials, Philadelphia, 1992).

*Primary Examiner*—Ellen M. McAVoy
*Attorney, Agent, or Firm*—John C. Martin, Jr.

[57] ABSTRACT

The present invention relates to a diesel fuel which contains a synergistic combination of an organic peroxidic additive such as ditertiary butyl peroxide in combination with a propylene or butylene glycol monoalkyl ether or polyol, the combination of additives providing for reduced fuel emissions and improved fuel economy.

10 Claims, No Drawings

DIESEL FUEL

BACKGROUND OF THE INVENTION

1. Field of the Invention

The present invention relates to an improved diesel fuel which contains a synergistic combination of additives comprised of a peroxidic cetane booster such as ditertiary butyl peroxide, together with an alkyl glycol ether having

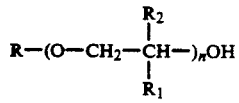

wherein R is an alkyl group, $R_1$ is a $C_1$-$C_2$ alkyl group, $R_2$ is hydrogen or methyl, and n is an integer of 1 through 5, or a polyol where R is hydrogen, n is 4 to 30, and $R_1$ and $R_2$ are as above.

2. Description of the Prior Art

Diesel fuels are known which contain a synergistic cetane improving additive combination of a peroxidic component and an aliphatic polyether of the formula $R(—O—X)_nO—R^1$ where R and $R_1$ are alkyl groups, X is an alkylene group and n is an integer. See U.S. Pat. No. 2,655,440 and divisional U.S. Pat. No. 2,763,537.

European Application 80-100827.7 describes the use of various propylene glycol mono- an di-ethers as a component of diesel fuels. The compositions described in this reference involve a multicomponent formulation which includes polyethers, acetals, lower alkanols, water and up to 85 volume % diesel fuel hydrocarbons. The specific synergistic formulation of the present invention is not taught or described.

U.K. 1,246,853 describes the addition of dialkyl ethers of propylene glycol as smoke suppressants in diesel fuel.

U.S. Pat. No. 4,753,661 describes a fuel conditioner which comprises a polar oxygenated hydrocarbon which may be combined with a compatibilizing agent which is an alcohol and which may be tripropylene glycol monomethyl ether.

Japanese Published Application 59-232176 describes the use of the di-ethers of various polyoxyalkalene compounds as diesel fuel additives.

The Clean Air Act Amendments of 1990 have established certain emission standards for heavy duty diesel engines, in particular with regard to nitrogen oxide and particulate matter emissions. The contribution of diesel fuel sulfur content to exhaust particulates has been well established, and has led to an EPA regulation which will require highway diesel fuels to contain no more than 0.05 wt. % sulfur. In 1991, particulate matter emissions were required to drop from 0.60 to 0.25 grams/BHP-hr., and in 1994 the emission limit is 0:10. Similarly, nitrogen oxide will decrease from 6.0 to 5.0 in 1994 and from 5.0 to 4.0 grams/BHP-hr. in 1998. The California Air Resources Board (CARB) has issued regulations that are viewed as more difficult to meet than the EPA targets. To qualify a diesel fuel in California, emissions must be no greater than the CARB reference fuel which contains 0.05 wt. % maximum sulfur, 10% maximum aromatics and a minimum cetane number of 48.

Many strategies are being used by the industry to reduce emissions. Improved heavy duty diesel engine designs including higher injection pressures, turbocharging, air intercooling, retarded injection timing through electronic tuning control, exhaust gas recycle and exhaust aftertreatment devices all lower emissions. For this advanced technology to work, a high quality, low emissions diesel fuel is required in addition to the use of various fuel additive improvements including cetane improver use, diesel fuel detergents to keep fuel injectors clean and improved low ash engine oils. A combination of these strategies will be utilized to meet new clean air standards. The key issue is to find the most effective combination of technologies which offer the best cost/performance.

Fuel regulations, especially those promulgated in California, will require costly changes in diesel fuel composition. Desulfurization to achieve the 0.05 wt.% sulfur target is easily accomplished through mild hydrogenation. However, refiners must use deep hydrogenation to decrease aromatic content from the current 30–40% aromatic level down to 10%. Many refiners have elected to exit the California diesel fuel market rather than making the high capital investment required for deep hydrogenation. At least one refiner was able to qualify a diesel fuel for California by lowering the aromatics to 19% and increasing the cetane number from 43 for a typical fuel up to around 60 using an alkyl nitrate cetane improver.

The present invention relates to an additive combination of peroxide cetane improver and an alkyl glycol monoether or polyol which, when incorporated in standard 30–40% aromatic containing diesel fuel, provides reduced emissions of nitrogen oxides, particulate matter, hydrocarbons, carbon monoxide and unregulated aldehyde emissions, thus providing a fuel capable of meeting even the California standards. In addition, the use of the additive combination of the present invention provides a synergy whereby a significant increase in fuel economy is achieved.

BRIEF DESCRIPTION OF THE INVENTION

In accordance with the invention, reduced emissions of NOx, particulate matter, hydrocarbons, and carbon monoxide as well as significantly improved fuel economy is achieved with diesel fuel having incorporated therein an additive combination comprised of a peroxidic additive such as dialkyl peroxide together with a propylene or butylene glycol ether having the formula

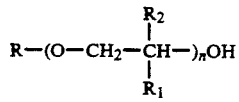

wherein R is an alkyl group, $R_1$ is a $C_1$-$C_2$ alkyl group, $R_2$ is hydrogen or methyl, and n is an integer of 1 through 5, or a polyol where R is hydrogen, n is 4 to 30, and $R_1$ and $R_2$ are as above.

DETAILED DESCRIPTION

The hydrocarbon based diesel fuels utilized in the practice of this invention are comprised in general of mixtures of hydrocarbons which fall within the diesel fuel boiling range, typically about 160° to about 370° C. The fuels are often referred to as middle distillate fuels since they comprise the fractions which distill after gasoline. The diesel fuels of the invention have a low sulfur content, i.e. not more than 500 ppm by weight, preferably not more than 100 ppm and preferably not more than 60 ppm sulfur. Aromatic content of the fuel comprises 5-50% by volume, preferably 20-35% by volume.

One component of the additive combination which is employed in practice of the invention is an organic peroxidic additive of a type known to improve the cetane number of diesel fuels. Especially preferred are the dialkyl peroxides of the formula R''OOR''' wherein R'' and R''' are the same or different alkyl groups having 1 to 10 carbon atoms. The peroxide cetane improvers must be soluble in the fuel and must be thermally stable at typical fuel temperatures of operating engines. Peroxides wherein R'' and R''' are tertiary alkyl groups having 4 or 5 carbon atoms are especially useful.

Examples of suitable peroxides include ditertiary butyl peroxide, ditertiary amyl peroxide, diethyl peroxide, di-n-propyl peroxide, di-n-butyl peroxide, methyl ethyl peroxide, methyl-t-butyl peroxide, ethyl-t-butyl peroxide, propyl-t-amyl peroxide and the like. The preferred peroxides have good solubilities in diesel fuel, have superior water partition coefficient characteristics, have good thermal stability and handling characteristics, have no impact on fuel quality or fuel system components, and have low toxicity.

The propylene or butylene glycol ether or polyol component employed in the invention has the formula

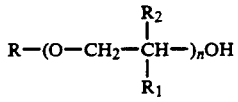

wherein R is an alkyl group, preferably having 1-10 carbon atoms, $R_1$ is a $C_1$-$C_2$ alkyl group, $R_2$ is hydrogen or methyl, and n is 1 through 5 for the ethers, and where R is hydrogen, n is 4 to 30, preferably 10 to 25, and $R_1$ and $R_2$ are as above for the ethers.

Examples are propylene glycol monomethyl ether, propylene glycol monoethyl ether, propylene glycol monopropyl ether, propylene glycol mono-n-butyl ether, propylene glycol mono-t-butyl ether, propylene glycol mono-n-amyl ether, dipropylene glycol monomethyl ether, dipropylene glycol monopropyl ether, dipropylene glycol mono-n-butyl ether, dipropylene glycol mono-t-butyl ether, dipropylene glycol mono-n-amyl ether, dipropylene glycol mono-t-amyl ether, tripropylene glycol monomethyl ether, tripropylene glycol monoethyl ether, tripropylene glycol monopropyl ether, tripropylene glycol mono-n-butyl ether, tripropylene glycol mono-t-butyl ether, tripropylene glycol mono-n-amyl ether, tripropylene glycol mono-t-amyl ether, and the like.

Derivatives of 1, 2 butylene oxide which can be used include dibutylene glycol monoethyl ether, dibutylene glycol mono-n-propyl ether, dibutylene glycol monoisopropyl ether, dibutylene glycol mono-n-butyl ether, dibutylene glycol mono-t-butyl ether, tributylene glycol monoethyl ether, tributylene glycol mono-n-propyl ether, tributylene glycol monoisopropyl ether, tributylene glycol mono-n-butyl ether,, tributylene glycol mono-t-butyl ether, and the like. Corresponding derivatives of 2,3 butylene oxide and isobutylene oxide can be used.

Polyols which can be used are those having the formula

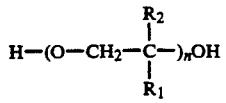

where $R_1$ is $C_1$-$C_2$ alkyl, $R_2$ is hydrogen or methyl, and n is 4 to 30, preferably 10 to 25.

Especially preferred additives employed in accordance with the invention are those having the following formula:

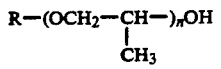

wherein R is a $C_4$ or $C_5$ alkyl group, and n is 1 to 3. The preferred additives have good solubilities in diesel fuel hydrocarbons, do not raise the flash point of the blend above 52° C., have low toxicity, have no impact on fuel system components such as elastomers, have superior water partition coefficient characteristics and are effective in reducing emissions.

Generally, the peroxide additive is employed in amounts varying from 0.01 to about 5 vol. % of the fuel composition, preferably 0.01 to 1.5 vol. %, and the propylene or butylene glycol ether or polyol in amounts varying from 0.1 to about 15 vol. % of the fuel composition, preferably 0.2 to 10 vol. %.

Conventional additives and blending agents for diesel fuel may be present in the fuel compositions of this invention in addition to the above components. For example, the fuels of this invention may contain conventional quantities of such conventional additives as friction modifiers, detergents, antioxidants, heat stabilizers, other cetane improvers and the like.

Example

The diesel fuel compositions used in this example are as follows:

| | FUEL COMPOSITIONS | | | |
|---|---|---|---|---|
| | Reference | Test | CARB* | CARB Specs |
| Cetane No. | 43 | 53 | 52 | 48 Min. |
| Sulfur (wt. %) | 0.038 | 0.038 | 0.039 | 0.05 Max. |
| Aromatics (Vol. %) | 31 | 30 | 8.5 | 10 Max. |

*This fuel was obtained from Phillips Petroleum and the aromatic content was established through NMR analysis.

To a reference diesel hydrocarbon fuel there were added tripropylene glycol monomethyl ether (TPM) and di-tertiary butyl peroxide (DTBP) such that the final formulation contained 2 vol. % TPM and 0.70 volume % DTBP. The cetane number of the reference fuel was increased from 43 to 53 for the test fuel. Cetane response is typically dependent on the aromatic content and quality of the reference fuel.

TPM meets the qualification tests for use in diesel fuel. When used at the 5% level, the fuel flash point is 74° C. This is higher than the 52° C. flash point requirement needed for transportation through a diesel fuel pipeline. The TPM in diesel fuel is completely soluble at the 5% level. The water partition coefficient with 10:1 blend to water ratio is around 10 to minimize extraction into a water phase during transport or storage. Also, the TPM does not increase the solubility of water in the diesel fuel. The DTBP has a water partition coefficient of 0.01. In addition, TPM and DTBP are completely stable when combined into diesel fuel.

The reference fuel and the CARB fuel were compared to the above test fuel using the standard EPA hot start transient test protocol in a Detroit Diesel Series 60 1991 heavy duty diesel engine. This is the same engine used by Southwest Research Institute to evaluate diesel fuels against the lot aromatic CARB fuel for qualification in Calif. Results are as follows:

| | EMISSIONS (Grams/BHP-hr.) | | | |
|---|---|---|---|---|
| | Reference | CARB | Test | GE-Increase* |
| PM | 0.179 | 0.153 | 0.160 | 0.151 |
| NOX | 4.18 | 4.00 | 4.04 | |
| Hydrocarbons | 0.41 | 0.14 | 0.15 | |
| Carbon Monoxide | 1.93 | 1.30 | 1.23 | |

*Results show increasing the alkyl glycol ether (GE) content from 2% TPM for the test fuel to 5% can further reduce particulate matter to the level achieved with the CARB fuel.

With the increase in glycol ether, the PM emission profile of the CARB fuel can be met. When experimental error is taken into consideration, the test and CARB fuel are identical.

Depending on the ether or polyol choice, particulates can be reduced from 10–20%. Results using TPM alone show the magnitude of particulate reduction correlates well with the percent oxygen concentration in the oxygenated additive. Sulfates are reduced by 36% with TPM and the soluble organic fraction, which is essentially unburned fuel, is reduced by 48%.

Aldehydes and ketones, which currently are not regulated emissions, are potential carcinogens. Results also show a substantial reduction when the 2% TPM and 0.7% DTBP are added to the reference fuel.

| | % REDUCTION* |
|---|---|
| ALDEHYDES | |
| $C_1$ | 62 |
| $C_2$ | 61 |
| $C_3$ | 66 |
| ACROLEIN | 80 |
| CROTONAL | 70 |
| $C_6$ | 71 |
| KETONES | |
| ACETONE | 5 |
| METHYL ETHYL KETONE | 56 |

*Reduction for oxygenated test fuel versus the reference fuel.

One problem associated with peroxide cetane additives is decomposition during use. The modern fuel system of the Detroit Diesel Series 60 engine could magnify this problem because the fuel is heated to around 60–65° C. as the fuel passes through the fuel injector unit. Some of the fuel is injected and burned while the rest is recycled back to the fuel tank. The build-up of active oxygen for the test fuel was monitored after two days of fuel use in the engine. Results show no active oxygen increase demonstrating the DTBP and TPM containing fuel is stable and results in no increase in decomposition over the reference fuel.

The results also show the Brake Specific Fuel Consumption was 1.4% less than the reference fuel. An improvement in fuel economy was not obtained with DTBP alone or with the combination of TPM and ethyl hexyl nitrate.

The above data demonstrates that the additive combination employed in practice of the invention dramatically reduces engine emissions while at the same time significantly reducing fuel consumption giving improved fuel economy. The striking feature of the invention is the achievement of an emission profile normally associated with a 10% aromatic diesel fuel by using a 31% aromatic low sulfur diesel fuel containing a peroxide cetane improver and an oxygenated additive such as TPM while reducing fuel consumption. The cost for this invention is dramatically less than the cost to the refiner for providing a 10% aromatic diesel fuel using deep hydrogenation technology.

I claim:

1. A fuel composition comprising a major proportion of hydrocarbons boiling in the diesel fuel range and containing less than 500 ppm sulfur, and an amount of an additive combination of an organic peroxidic component and an additive of the formula

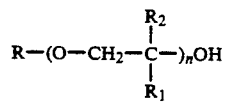

effective to reduce engine emissions and improve fuel economy, R being an alkyl group having 1–10 carbon atoms, $R_1$ being a $C_1$-$C_2$ alkyl group, $R_2$ being hydrogen or methyl and an integer from 1 to 5, or R being hydrogen and n being 4–30.

2. The composition of claim 1 wherein the peroxidic component is a dialkyl peroxide.

3. The composition of claim 1 wherein the peroxidic component is a ditertiary alkyl peroxide.

4. The composition of claim 1 wherein R is an alkyl group and $R_1$ is a methyl group.

5. The composition of claim 1 wherein R is a $C_4$ or $C_5$ tertiary alkyl group and $R_1$ is a methyl group.

6. The composition of claim 1 wherein R is hydrogen and n is 4 to 30.

7. The composition of claim 1 wherein R is hydrogen and n is 10 to 25.

8. A fuel composition comprising a major proportion of hydrocarbons boiling in the diesel fuel range and containing less than 500 ppm sulfur and an amount of an additive combination of ditertiary butyl peroxide and a propylene glycol monoalkyl ether effective to reduce engine emissions and improve fuel economy.

9. The composition of claim 8 wherein the propylene glycol monoalkyl ether is tripropylene glycol monoalkyl ether.

10. The composition of claim 8 wherein the propylene glycol monoalkyl ether is tripropylene glycol monomethyl ether.

* * * * *